US008967711B2

(12) United States Patent
Weber et al.

(10) Patent No.: US 8,967,711 B2
(45) Date of Patent: Mar. 3, 2015

(54) SWIVEL JOINT FOR SEATING IMPLEMENT

(75) Inventors: Reinhard Weber, Minden (DE); Paul Sprafke, Leonberg (DE)

(73) Assignee: VS Vereinigte Spezial Mobelfabriken GmbH & Co. KG, Tauberbischofsheim (DE)

( * ) Notice: Subject to any disclaimer, the term of this patent is extended or adjusted under 35 U.S.C. 154(b) by 606 days.

(21) Appl. No.: 13/316,275

(22) Filed: Dec. 9, 2011

(65) Prior Publication Data

US 2012/0146367 A1 Jun. 14, 2012

(30) Foreign Application Priority Data

Dec. 14, 2010 (DE) ..... 10 2010 054 435

(51) Int. Cl.
*A47B 39/00* (2006.01)
*A47C 7/70* (2006.01)
*A47C 3/04* (2006.01)

(52) U.S. Cl.
CPC .... *A47C 7/70* (2013.01); *A47C 3/04* (2013.01)
USPC ..... 297/160; 297/162; 297/170; 297/170 R; 403/119

(58) Field of Classification Search
CPC ..... A47C 7/70; A47C 1/03
USPC ..... 297/160, 162, 170, 170 R; 403/119
See application file for complete search history.

(56) References Cited

U.S. PATENT DOCUMENTS 2,994,366 A 8/1961 Hoch
3,368,842 A * 2/1968 Polsky ..... 297/162
3,375,038 A 3/1968 Krueger
3,567,277 A 3/1971 Van Ryn
3,712,668 A 1/1973 Fink
3,847,432 A 11/1974 Jennings
4,159,846 A * 7/1979 Tolleson ..... 297/162
5,765,911 A 6/1998 Sorenson
5,893,607 A 4/1999 Trimmell (Continued)

FOREIGN PATENT DOCUMENTS

DE 2 050 322 4/1972
DE 298 19 878 U1 2/1999

(Continued)

OTHER PUBLICATIONS

Extended European Search Report, European Patent Application No. 11009638.5, Mar. 30, 2012, 6 pages.

(Continued)

*Primary Examiner* — Laurie Cranmer

(57) ABSTRACT

A swivel joint for pivotably coupling a tray to a support element of a seating implement. The swivel joint includes a tubular inner structure arranged substantially coaxially with and non-rotatably connectable to the support element, and a mounting structure at least partially surrounding the tubular inner structure in a radial direction. The mounting portion is pivotable relative to the tubular inner structure and rigidly coupled to the tray. The tubular inner structure includes at least one opening extending in the peripheral direction between two angular positions, and the mounting structure has at least one projection which projects in a radial direction and engages with the at least one opening of the tubular inner structure. The swivel joint provides additional structural integrity to compensate for loads on the tray and also provides a pivoting point to allow the tray to move easily between positions of use and non-use.

22 Claims, 7 Drawing Sheets

(56) References Cited

U.S. PATENT DOCUMENTS

| | | | | |
|---|---|---|---|---|
| D417,342 | S | 12/1999 | Holbrook | |
| 6,095,598 | A * | 8/2000 | Piretti | 297/115 |
| 6,220,658 | B1 * | 4/2001 | Lukawski et al. | 297/145 |
| 6,224,149 | B1 * | 5/2001 | Gevaert | 297/162 |
| 6,634,717 | B2 * | 10/2003 | Kown | 297/446.2 |
| 6,669,282 | B2 | 12/2003 | Piretti | |
| 6,837,539 | B1 * | 1/2005 | Casey | 297/162 |
| 7,731,277 | B2 * | 6/2010 | Weber et al. | 297/162 |
| 2006/0109257 | A1 * | 5/2006 | Ambasz | 345/173 |
| 2007/0284920 | A1 * | 12/2007 | Mehaffey et al. | 297/162 |
| 2008/0203778 | A1 | 8/2008 | Weber et al. | |

FOREIGN PATENT DOCUMENTS

| | | | |
|---|---|---|---|
| DE | 20 2007 002 863 | U1 | 5/2007 |
| EP | 1 266 596 | B1 | 12/2002 |
| EP | 1 647 211 | A1 | 10/2005 |
| NL | 1023669 | | 12/2004 |
| WO | WO 03/015577 | A1 | 2/2003 |

OTHER PUBLICATIONS

European Search Report dated Oct. 14, 2009 (EP 1964493), 5 pages.

* cited by examiner

SWIVEL JOINT FOR SEATING IMPLEMENT

RELATED APPLICATIONS

This application claims the benefit under 35 U.S.C. §119 of German Utility Model Application No. DE 10 2010 054 435.3, filed Dec. 14, 2010, which is hereby incorporated by reference in its entirety.

TECHNICAL FIELD

The field of the disclosure generally relates to joints and linkage mechanisms for desks and other seating implements for pivotably supporting a desk tray. In particular, the disclosure relates to swivel joints designed and configured in a manner suitable for supporting increased loads on the desk tray.

BACKGROUND

U.S. Pat. No. 7,731,277 of Weber et al. discloses a seating implement with a base frame structure and a tray, wherein the tray is dimensioned to support a notebook computer or other objects and is mounted to a support element of the base frame structure by way of a swivel joint. To support increased loads (in comparison with a smaller writing desk), such as when a computer or other object rests on the tray, a portion of the support element to which the swivel joint is mounted extends substantially horizontally and at an angle of between about 35 degrees and 60 degrees relative to the main seat direction of the seating implement. Such a configuration allows the support element to extend a distance underneath the tray to provide additional support and structural integrity. In addition, when the tray is upwardly pivoted in a position of non-use, it is possible to comfortably get into and out of the seating implement.

The present inventors have identified a need for a low-maintenance and structurally sound swivel joint on a seating implement, where the swivel joint is configured to support increased loads. The present inventors have also identified a need for such a swivel joint that can be easily assembled with few and relatively inexpensive parts. In addition, the present inventors have identified a need for a support element mounted to the swivel joint in an orientation in which the support element extends substantially parallel to the main seat direction of the seating implement to reduce interference of the joint mechanism with a user occupying the seating implement.

SUMMARY

An apparatus is disclosed for improved seating implements having a joint, such as a swivel joint, for pivotably mounting a second article (such as a desk tray, tablet, or other structure of any size and shape, including a plate-shaped configuration) to a first article (such as a supporting structure having a tubular cross-section), where the swivel joint is configured for supporting increased loads due to, for example, the weight of the second article itself and loads supported by the second article. The first article may include support elements of any suitable cross-section and can be hollow or solid, as desired. In some embodiments, the swivel join may be fixed to and carried at a side or end edge of the second article. Alternatively, the joint may also be mounted to an inner or central portion of the second article.

In some embodiments, the joint comprises a tubular inner portion arranged substantially coaxially in relation to the first article and non-rotatably connectable thereto. The joint also includes an outer portion at least partially surrounding the tubular inner portion of the joint in the radial direction, where the outer portion is pivotable relative to the tubular inner portion of the joint between two end positions and may be fixedly connectable to the second article. The tubular inner portion and the outer portion each include at least one opening extending in the peripheral direction between two angular positions, and each also include at least one projection which projects in the radial direction inwardly and outwardly, respectively, and engages with the at least one opening of the tubular inner portion and the outer portion, respectively.

The pivotal movement of the joint occurs by the relative rotary movement between the tubular inner portion and the outer portion of the joint. In some embodiments, the pivotal angle of the joint ranges between about 60 degrees and 180 degrees. In other embodiments, the range is between about 75 degrees and about 150 degrees. In some embodiments, for optimized pivotal movement, the tubular inner portion comprises a substantially circular cross-section, which may surround the first article over its full periphery or over only part of its periphery.

The end positions of that pivotal movement may be predetermined by the boundaries of the at least one opening in the inner portion and outer portion, respectively, into which the at least one projection on the outer portion and inner portion, respectively, engages. The boundaries of the opening or openings may correspond in that respect substantially to the respective end positions of the second article. In some embodiments, the end positions of the swivel joint can manage without the involvement of additional fastening elements and without additional rotation-limiting elements.

The mutual engagement between the at least one opening and the at least one projection provides a high degree of stability to the swivel joint. Depending on the selected materials and dimensions of the components, a joint configured in a manner as described in this disclosure is suitable for supporting high loads. In such configurations, the swivel joint may, on its own, support the second article and any loads resting thereon without reliance on the supporting element.

In some embodiments, the shape, size, number and arrangement of the at least one opening and the at least one projection correspond to one other. In such configuration, basically any shape, size, number, and arrangement may be possible. In other embodiments, the at least one opening can extend the entire thickness of the tubular inner portion, or can only be in the form of a recess in the inner portion. In yet other embodiments, the numbers of openings and projections may be different, with one or a plurality of projections potentially engaging with each opening.

In some embodiments, to provide added stability of the joint, the projections may contact the inner portion in the axial and rest against the inside edges of stops in the openings, or have minimal clearance. The openings may be of a substantially uniform shape and size in the peripheral direction so that a pure rotary movement may be achieved (without additional movement in the axial direction).

In one embodiment the outer portion of the joint has at least one shell-shaped, mounting portion which at least partially embraces the inner portion and on which is provided the at least one projection or the at least one opening. Such construction of the outer portion with at least one mounting portion permits simple assembly of the joint. The outer portion of the joint may have two or more mounting portions which enclose the inner portion substantially over its full periphery. In addition, the mounting portions also comprise a shell-shaped configuration to embrace the tubular inner portion and rotate relative thereto.

In another embodiment, the outer portion of the joint has at least one housing portion non-rotatably connectable to and partially embracing the at least one mounting portion which can be fixedly connected to the second article. Such an embodiment may provide for simple assembly of the joint and the housing portion may serve to encapsulate the joint and its movable parts to reduce possible access or tampering with the joint and to decrease a risk of injury. In some embodiments, to further simplify assembly, the at least one housing portion of the outer portion can be pushed on in the axial direction over the at least one shell-shaped mounting portion and can be fixed in the axial direction by a securing means.

In another embodiment, the outer portion of the joint can be connected to the second article in a positively locking relationship. The positively locking relationship between the second article and the joint allows for direct transmission of the loads from the second article into the structurally stable joint. In addition to the positively locking connection to the second article, the outer portion of the joint can also be connected to the second article in a force-locking relationship.

In another embodiment, the at least one projection is a separate component connected to the outer portion or the inner portion, respectively, of the joint. In such embodiments, the projection can be constructed or may comprise a strong and structurally sound material capable of bearing heavy loads, such as steel, and the outer portion or the inner portion may be made from a less expensive and/or lighter weight material. Alternatively, the at least one projection may form a unitary or integral component of the outer portion or the inner portion, respectively, of the joint. In such embodiments, the number of separate components is reduced and assembly methods may be simplified.

In another embodiment, the at least one projection is of a substantially strip-shaped configuration in the axial direction of the inner portion to bear over a large surface area against the inside edges of the opening or openings, thereby increasing stability of the joint. The strip-shaped projection may extend in the axial and radial directions of the tubular inner portion of the joint.

In another embodiment, the tubular inner portion of the joint is a separate component from and non-rotatably connectable to the first article. In other embodiments, the tubular inner portion of the joint forms a unitary or integral component of the first article. In such embodiments, the assembly process may be simplified, as the number of components to be fitted together is reduced, and the stability of the non-rotatable connection may be increased. In embodiments where the inner portion of the joint is integral with the first article, the at least one opening, or the at least one projection, or both may also be integral or form a unitary structure with or on the first article.

In one embodiment, the tray support element is integral with or formed as a unitary structure of the base frame structure of the seating implement of furniture. Such a configuration, may serve to simplify the assembly process and increase the overall stability of the seating implement. In addition, loads on the desk tray may be redistributed from the joint to the base frame structure by way of the support element. In another embodiment, a portion of the support element, to which the joint is mounted, extends substantially horizontally (plus or minus 10 degrees) and substantially parallel (plus or minus 15 degrees) relative to a main direction of use of the article of furniture.

Additional aspects and advantages will be apparent from the following detailed description of preferred embodiments, which proceeds with reference to the accompanying drawings.

DETAILED DESCRIPTION OF PREFERRED EMBODIMENTS

With reference to the drawings, this section describes particular embodiments and their detailed construction and operation. The embodiments described herein are set forth by way of illustration only and not limitation. The described features, structures, and characteristics may be combined in any suitable manner in one or more embodiments. In view of the disclosure herein, those skilled in the art will recognize that the various embodiments can be practiced without one or more of the specific details or with other methods, components, materials, or the like. For the sake of clarity and conciseness, certain aspects of components are presented without undue detail where such detail would be apparent to those skilled in the art in light of the teachings herein and/or where such detail would obfuscate an understanding of more pertinent aspects of the embodiments.

As one skilled in the art will appreciate in light of this disclosure, certain embodiments may be capable of achieving certain advantages, including some or all of the following: (1) providing a seating implement with a tray or tablet support by a joint mechanism, where the joint mechanism is capable of supporting increased loads on the tray or tablet; (2) providing a seating implement that can be stacked with other similar or identical seating implements; (3) providing a seating implement with a pivoting tray for affording increased space for getting into and out of the seating implement; and (4) providing a joint mechanism that can be easily assembled with few and inexpensive parts.

In the following description of the figures and any example embodiments, the system may be described and referred to as a seating implement, such as a desk or chair, having a rotatable tray. It should be understood that such use is merely one use for such a system and should not be considered as limiting. Other uses for such a system with the characteristics and features described herein may be possible, for example, the system may include furniture for lying down, such as a patient bed, where the furniture includes a rotatable tray or other similar structure. Still other uses not described herein may be possible.

Figure 1:
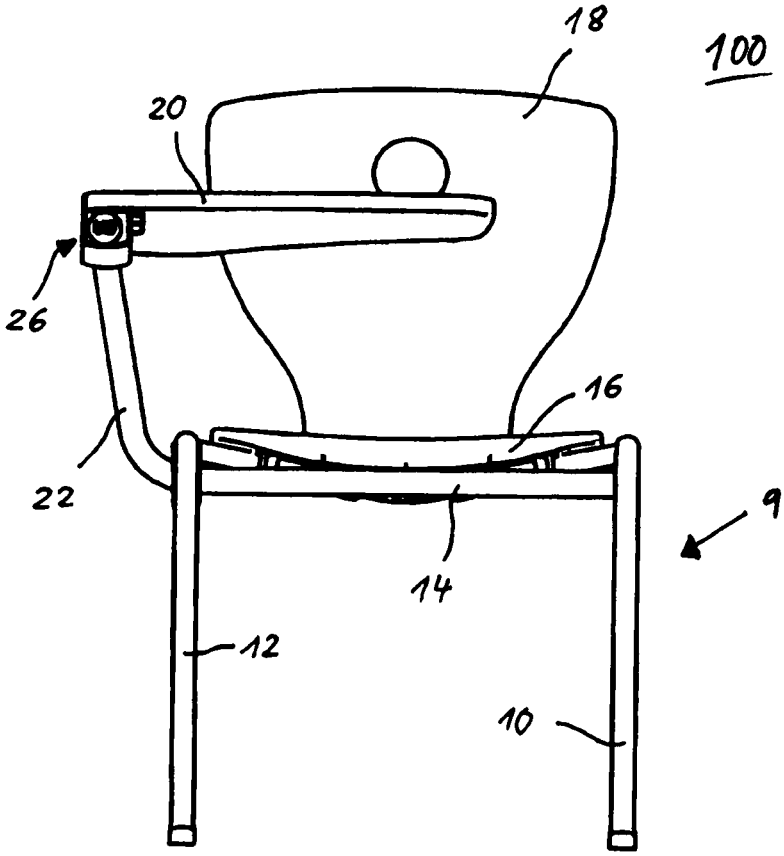
FIG. 1 is a front view of a seating implement with a tray mounted by way of a joint, according to one embodiment.
Figure 2:
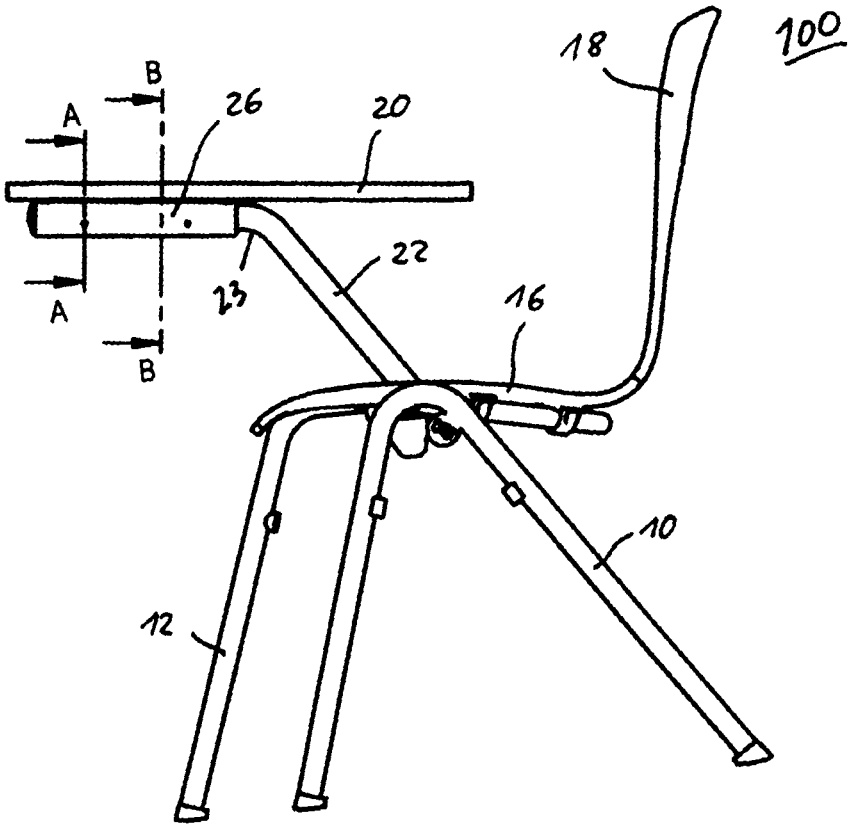
FIG. 2 is a side view of the seating implement of FIG. 1 with the tray in a position of use.
Figure 3:
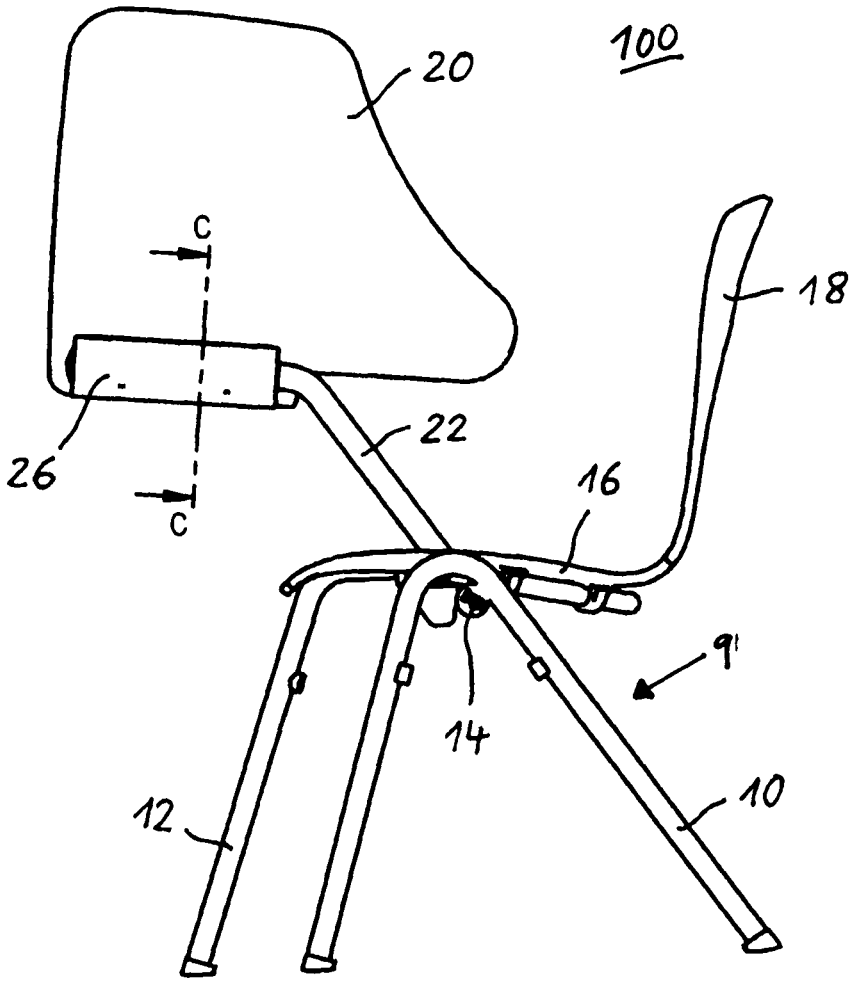
FIG. 3 is a side view of the seating implement of FIG. 1 with the tray in an upwardly-folded position of non-use.
Figure 8:
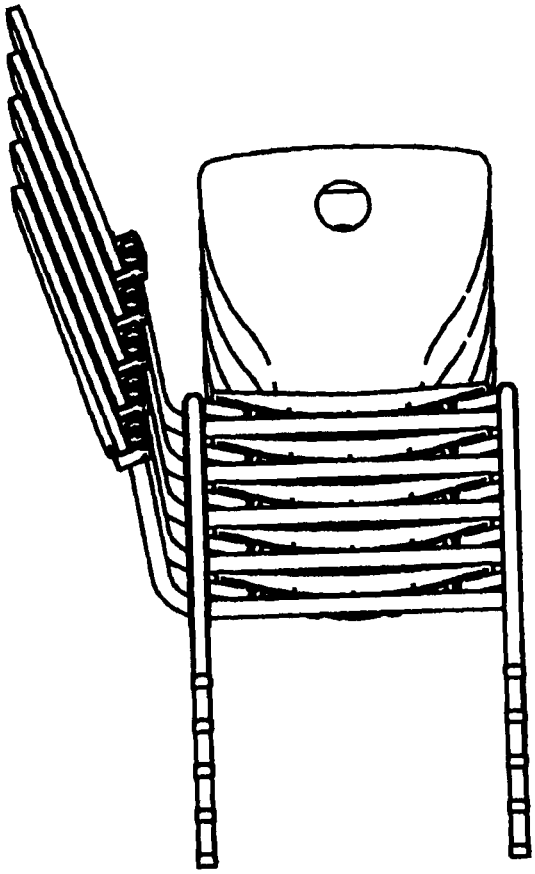
FIG. 8 is a front view of a stack of a plurality of seating implements with their respective trays in an upwardly-folded position of non-use, according to one embodiment.

FIGS. 1 and 2 illustrate various views of a chair with a side tray in its position of use; FIG. 3 shows the chair with the tray in its upwardly pivoted position of non-use; and finally FIG. 8 illustrates a plurality of such chairs in a stacked configuration with each of the trays in a pivoted position of non-use.

Referring now to FIGS. 1-3, the chair 100 includes a base frame structure 9 a seat 16, a backrest 18, and a hinged tablet or tray 20. In some embodiments, the seat 16 and the backrest 18 may be formed as a single, continuous unit. The base frame structure 9 of the chair 100 further includes a left-hand side frame 10 with two chair legs, a right-hand side frame 12 with two chair legs and at least one transverse bearer 14 connecting the left-hand and right-hand side frames 10, 12 together and serving as a support for the seat 16. According to one embodiment, the chair leg portions of the respective frames 10, 12 comprise a unitary, continuous structure. The left-hand and right-hand side frames 10, 12 may be configured, sized, and dimensioned in a corresponding fashion such that a plurality of chairs 100 can be stacked as illustrated in FIG. 8. The tray 20 may be sized and dimensioned to provide a workspace area as desired, while providing sufficient clearance for the user sitting in the chair 100 so the user does not feel constricted by the tray 20. For example, in some embodiments, the tray 20 may have length and width dimensions of up to 500 mm by 600 mm. In other embodiments, dimensions of up to 450 mm by 600 mm. In yet other embodiments, the tray 20 may have a maximum length of about 560 mm, a maximum width of about 400 mm. In still other embodiments, the tray 20 may have a surface area of between 0.25 square meters and 0.3 square meters. According to another embodiment, the tray 20 comprises a substantially planar panel having dimensions in the range as previously described to support a laptop computer or other similar devices.

In some embodiments, the seat 16 and the backrest 18 may comprise separate structures coupled or connected together by a supporting structure in an angular relationship as desired to provide a comfortable and/or ergonomic seating position. In other embodiments, the frames 10, 12 may each comprise two or more independent structures coupled or otherwise joined together by way of suitable longitudinal and transverse bearers to form the frames 10, 12.

As is understood by one having ordinary skill in the art, the chair 100 and all of its components may be constructed from any suitable materials as desired. For example, the base frame structure 9 may be constructed from metal or metal alloys, such as steel, and the seat 16, backrest 18, and tray 20 may be constructed from plastic or wood. In some embodiments, the seat 16 and/or backrest 18 may include a fabric or cushioned covering to provide additional comfort. In other embodiments, the chair 100 and its components may be constructed from other materials, which may depend on various factors such as weight, cost, durability, and availability of materials.

The chair 100 further includes a support element 22 coupled to the base frame structure 9 for supporting the tray 20. In one embodiment, the support element 22 is an elongated tubular structure, but may comprise other cross-sectional shapes, for example a square shaped bar. The support element 22 may be coupled to the base frame structure 9, for example, it may be attached or welded to the right-hand side frame 12 or one of the transverse bearers 14, or it may be formed as a continuous, single structure in conjunction with either of the side frames 10, 12 or the transverse bearer 14. For convenience, the support element 22 is described in relation to the right-hand side frame 12, but it should be understood that this adopted convention is not meant to be limiting and that the same concept applies to embodiments where the support element 22 is positioned near the left-hand side frame 10.

The support element 22 has an elongated first portion which extends in a plane substantially parallel to the plane of the right-hand side frame 12 on the side remote from the seat inclined forwardly and upwardly from the latter. An upper end 23 of that elongated first portion determines the height of the tray 20 in its position of use (see FIGS. 1 and 2). The height of the tray 20 may be increased by lengthening the elongated first portion to change the position of the upper end 23. The support element 22 further includes a second portion (extending within joint mechanism 26) joining, either directly or by way of intermediate connectors, the first portion along the upper end 23. The second portion of the support element 22 extends in a substantially horizontal plane (plus or minus 10 degrees) and substantially parallel (plus or minus 15 degrees) relative to the main seating direction of the chair 100 (right/left direction in FIGS. 2 and 3).

The tray 20 is mounted by means of a joint mechanism 26 to the horizontal second portion of the support element 22 in such a way that the tray 20 is pivotable about an axis substantially parallel to that second portion of the support element 22 between a horizontal position of use (see FIGS. 1 and 2) and an upwardly pivoted position of non-use (see FIGS. 3 and 8). The pivot axis of the tray 20 extends substantially parallel to the main seating direction of the chair 100 and laterally relative to the chair 100, such that when the tray 20 is in the upwardly-pivoted position of non-use, the chair 100 affords a user a sufficiently large and comfortable way of getting into and out of the chair 100.

The pivotal angle afforded by the joint 26 is greater than 90 degrees and, in some embodiments, may be between about 110 degrees to 135 degrees to allow the tray 20 to be held in its upwardly-pivoted position of non-use solely by its own weight. In other embodiments, the pivotal angle may be different, such as between than 135 degrees and 180 degrees. In such configurations, the tray 20 is not oriented exactly vertically in its position of non-use (see FIGS. 6 and 8) to provide for a plurality of such chairs 100 to be stacked. In other embodiments, the pivotal angle may be exactly 90 degrees, but such configurations will inhibit the stackability of the chairs 100 because the upright orientation of the tray 20 will not be conducive to stacking. The range of optimum pivotal angles of the tray 20 may depend on the dimensions of the tray 20 and the stacking spacing of the chairs.

Figure 4:
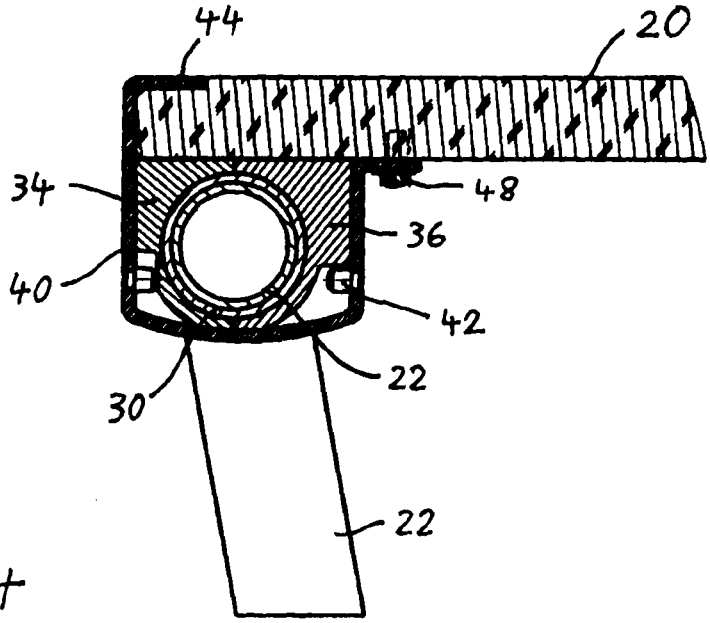
FIG. 4 is a cross-sectional view taken along section A-A of the joint in FIG. 2.
Figure 5:
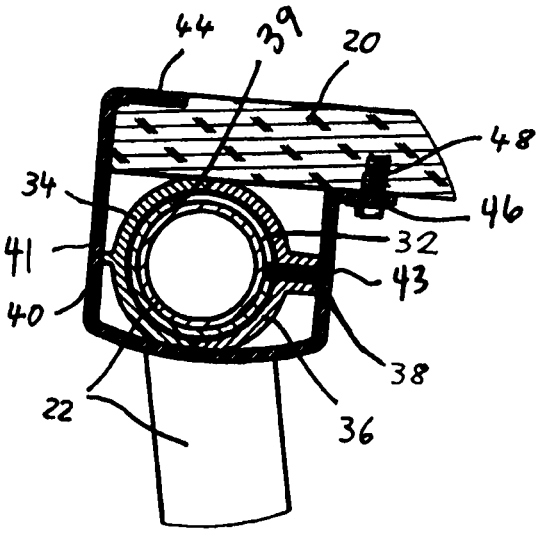
FIG. 5 is a cross-sectional view taken along section B-B of the joint in FIG. 2.
Figure 6:
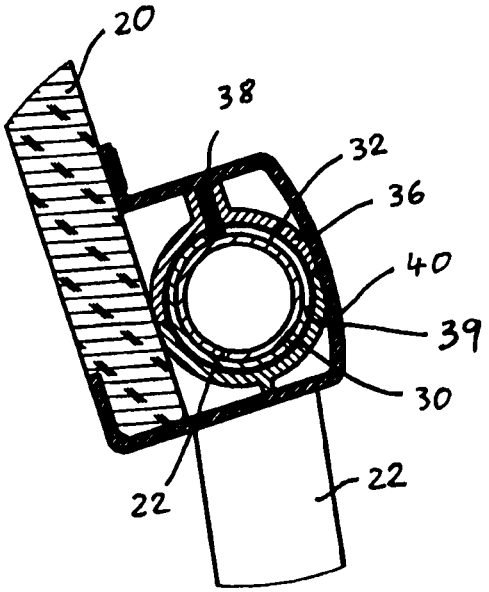
FIG. 6 is a cross-sectional view taken along section C-C of the joint in FIG. 3.
Figure 7:
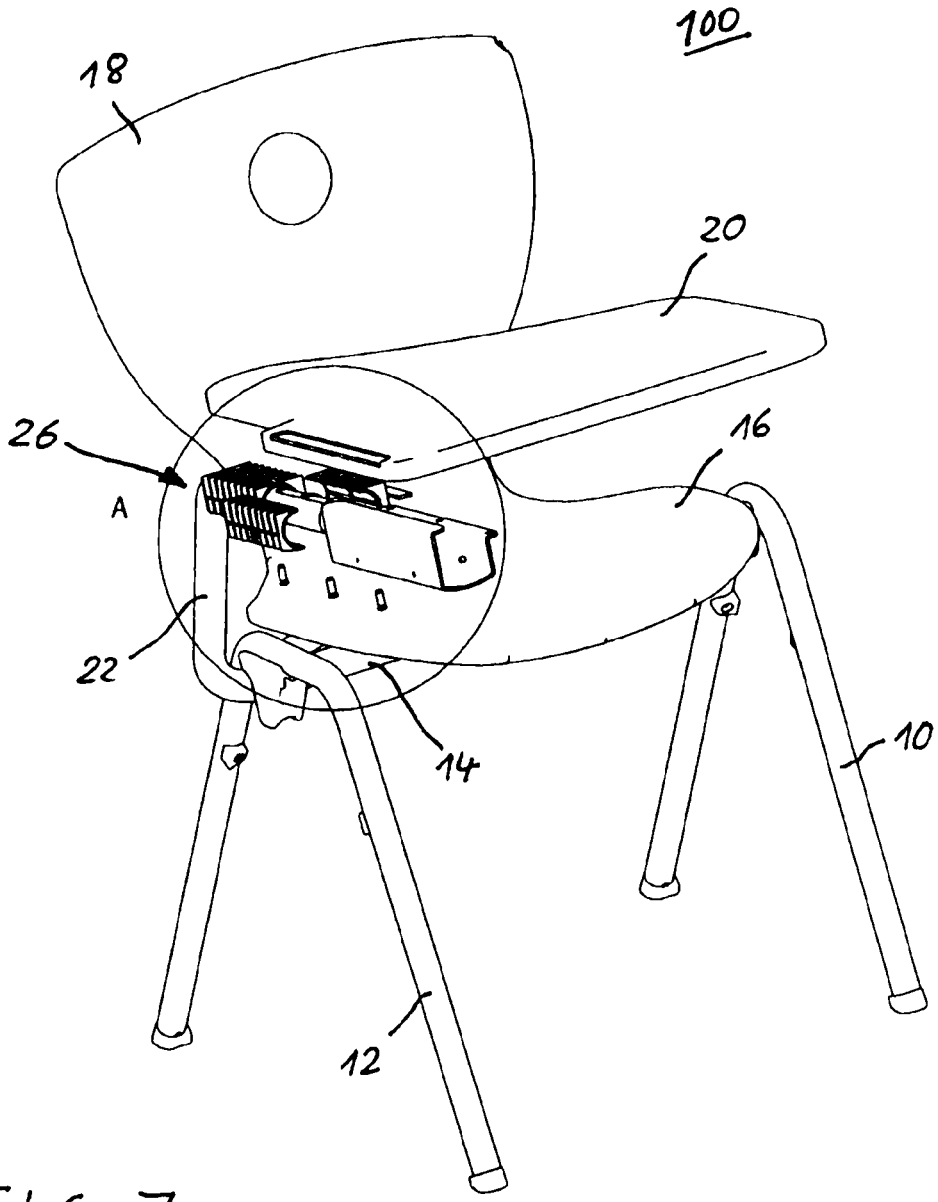
FIG. 7 is a perspective view of the seating implement of FIG. 1 illustrating an exploded view of the joint.
Figure 7A:
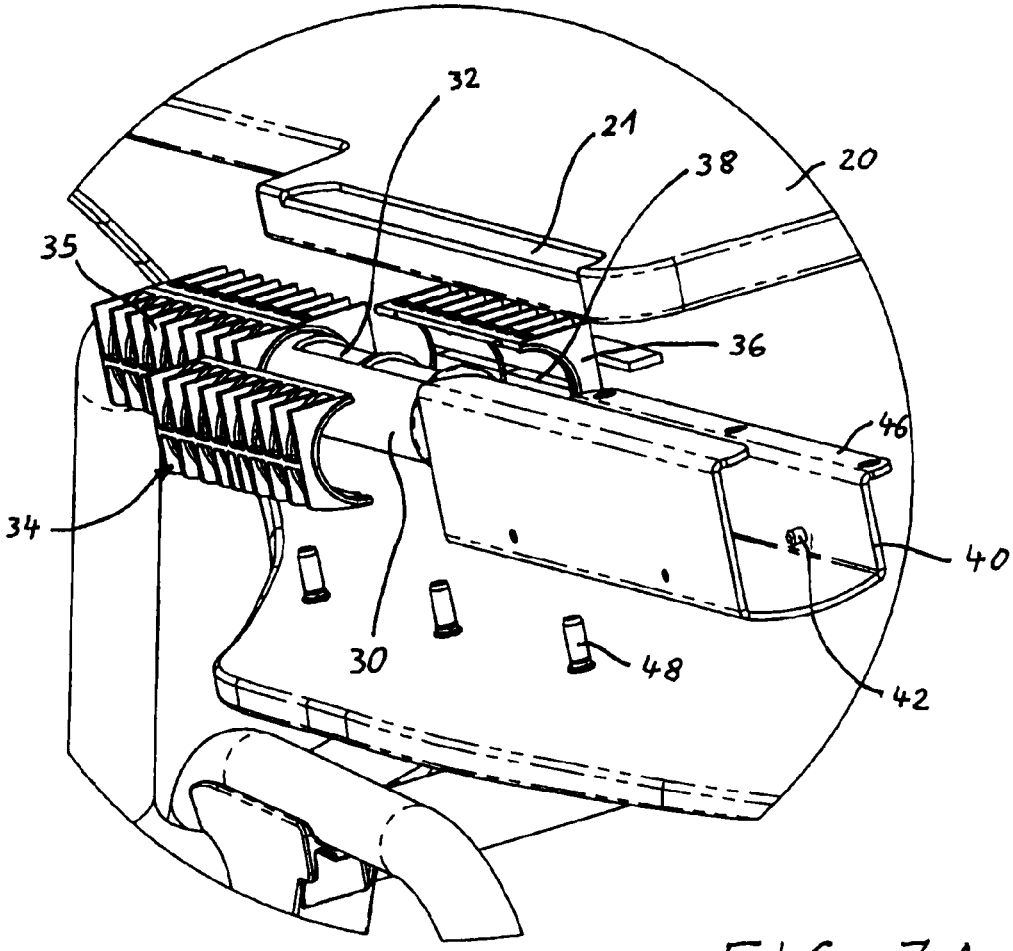
FIG. 7A is an enlarged view of the joint in FIG. 7.

FIGS. 4 through 6 illustrate cross sectional views of a swivel joint 26 and FIGS. 7 and 7A illustrate enlarged view of the joint 26 for pivotably supporting the tray 20. With reference to FIGS. 4 through 7A, the joint 26 has a tubular inner portion 30 and may be made of metal, such as steel, which is non-rotatably connectable, for example welded or screwed, or otherwise engaged around the support element 22. A pair of openings 32 are provided along the inner portion 30 and may be in the form of window-like through orifices which are of a substantially rectangular configuration and are arranged one behind the other in the axial direction of the inner portion 30.

In some embodiments, the inner portion 30 may be formed as a continuous structure of the support element 22. In such embodiments, the openings 32 may be provided directly on the support element 22.

The joint 26 further has an outer portion embracing the inner portion 30 and the support element 22. That outer portion may be rotatable relative to the inner portion 30 of the joint 26 and thus relative to the support element 22. In other embodiments, the tray 20 can be fixed in positively locking relationship and non-rotatable with respect to the outer portion of the joint 26.

The outer portion of the joint 26 includes two shell-shaped mounting portions 34, 36 which may be made from a plastic or other lightweight material. The two mounting portions 34, 36 may be of substantially the same shape with respect to each other to reduce the production costs for the joint 26. To increase stability, the mounting portions 34, 36 may each include numerous stiffening ribs 35 on an outside surface facing away from the inner portion 30 (see FIG. 7A).

The two mounting portions 34, 36 of the outer portion together embrace the inner portion 30 over at least a portion of its periphery, but may also embrace the full periphery of the inner portion 30. In addition, mutually facing ends of the two mounting portions 34, 36 may be provided with or formed with complementary latching and/or clamping devices (for example pins and bores or noses and openings) to allow for the mounting portions 34, 36 to be fixedly assembled about the inner portion 30 in a preliminary assembly step.

The inside surface of the mounting portions 34, 36, the surface facing toward the inner portion 30, is of a corresponding shape to the external shape of the inner portion 30 to provide the embracing relationship previously described. In addition, the material of the mounting portions 34, 36 may be selected to provide a sufficiently low coefficient of sliding friction between the inner portion 30 and the mounting portions 34, 36 so that the tray 20 can be easily pivoted by the user with minimal effort, but not so low that the tray 20 will move too easily and disrupt the stability of the tray 20. For example, the inner portion 30 may be made of steel and the mounting portions 34, 36 may be made of a synthetic material (e.g. PTFE, PA, PP, PE, etc.) with an addition of about 5% to 15% by weight percent of talcum, such that the coefficient of sliding friction ranges between 0.25 and 0.35. In other embodiments, the materials for the inner portion 30 and the mounting portions 34, 36 may be different than those described such that the coefficient of sliding friction is about 0.4.

The outer portion of the joint 26 further includes a housing portion 40 that may be made from metal, such as steel, and embracing the two mounting portions 34, 36 over the full periphery thereof. The mounting portions 34, 36 with their reinforcing ribs 35 and the housing portion 40 are such that the housing portion 40 embraces the two mounting portions 34, 36 substantially in positively locking relationship and thus non-rotatably connects thereto. As an additional securing means in the axial direction, provided on both mounting portions 34, 36 are two respective securing pins 42, which in the assembled condition of the joint 26, respectively project between two adjacent reinforcing ribs 35 of the respective mounting portion 34, 36.

The mounting portions 34, 36 may include two elongate openings provided in succession in the axial direction of the inner portion 30. Fitted, such as by a press fit, into those openings are two strip-shaped projections 38. The projections 38 may be made from metal, such as steel, and are arranged in a corresponding fashion to the openings 32 in the inner portion 30. The projections 38 are also of a length corresponding to the inside dimensions of the openings 32 in the inner portion 30 in the axial direction. The projections 38 may be formed as a unitary structure in relation to the mounting portions 34, 36 or may be formed as separate components and thereafter welded or otherwise attached.

It should be understood that while in the described example embodiments the openings 32 are provided on the inner portion 30 and the strip-shaped projections 38 are fitted into the mounting portions 34, 36 of the outer portion, in other embodiments, the projections 38 may be provided on the inner portion 30 and the corresponding openings 32 may be provided on the outer portion of the joint 26 and engaged in a similar fashion as previously described.

In the assembled condition of the joint 26, those strip-shaped projections 38 on the second mounting portion 36 engage into the openings 32 in the tubular inner portion 30 (see FIGS. 5 and 6). The pivotal travel of the outer portion relative to the inner portion 30 of the joint 26 is defined by the strip-shaped projections 38 abutting in the peripheral direction against the inside edges of stops 39 of the openings 32 in the inner portion 30. In the illustrated embodiment, the pivotal angle is about 125 degrees, wherein the one end position for the position of use of the tray 20 is almost horizontal.

In the illustrated embodiments, the angular positions of the boundaries of the openings 32 in the inner portion 30 of the joint 26 substantially correspond to the desired angular positions of the position of use and the position of non-use of the tray 20. In other embodiments, the openings 32 may be provided with a displacement in relation to those aforementioned angular positions.

The housing portion 40 of the outer portion of the joint 26 is of a generally U-shaped cross-sectional configuration, wherein an outwardly disposed limb 41 (see FIG. 5) is of greater length than an inwardly disposed limb 43 (see FIG. 5). Provided at the end of the outward limb 41 is an inwardly-directed external flange 44 which engages into a corresponding recess 21 in the outer edge of the tray 20 (see FIG. 7A). Provided at the end of the inward limb 43 is an outwardly-directed internal flange 46 which has a plurality of bores for receiving screws 48.

While in the foregoing embodiments the two shell-shaped mounting portions 34, 36 and the housing 40 are described as separate components, in one embodiment, an exterior portion of the mounting portions 34, 36 may form the housing 40 once the mounting portions 34, 36 are connected to one another so that the joint 26 does not include a separate housing 40, but the housing 40 is integrally formed as part of the mounting portions 34, 36. In other embodiments, there may only be one mounting portion or there may be more than two shell-shaped mounting portions 34, 36.

In operation, the tray 20 is received in positively locking relationship between the external flange 44, the outer limb 41, and the internal flange 46 of the housing portion 40 and fixed by the fixing screws 48 to the internal flange 46 of the housing portion 40. The tray 20 is thus secured non-rotatably to the housing portion 40 and accordingly to the outer portion of the joint 26. In such a configuration, the tray 20 can be rotated jointly with the outer portion of the joint 26 about the tubular inner portion 30, with the range of pivotal movement being defined by the openings 32 and the projections 38. The rotational limitation by the mutual engagement of openings 32 and projections 38 provides a highly stable joint 26 suitable for carrying heavy loads. This stability is accomplished with relatively few components and is of a simple and low-maintenance structure.

With reference to FIG. 7A, the following describes a process for assembling the joint 26 with the functionality and characteristics described previously. First, the tubular inner portion 30 with the openings 32 is pushed onto the horizontal portion of the support element 22 and welded or otherwise rigidly attached thereto in the desired rotational position of the openings 32. Thereafter, the two shell-shaped mounting portions 34, 36 are fitted laterally onto the inner portion 30 and pressed together. The mounting portions 34, 36 may be fixedly pre-assembled to the inner portion 30, such as by the previously described latching and/or clamping means.

Next, the housing portion 40 is then pushed in the axial direction over the two mounting portions 34, 36. The inwardly projecting external flange 44 of the housing portion 40 is guided only just above the mounting portion 34 so that the securing pins 42 are beneath the mounting portions 34, 36 to provide for axial movement.

Once the housing portion 40 has been positioned at its desired axial position over the mounting portions 34, 36, the housing portion 40 is moved upwardly so that the securing pins 42 engage into intermediate spaces between adjacent reinforcing ribs 35 of the mounting portions 34, 36 and thus fix the housing portion 40 relative to the mounting portions 34, 36.

Finally, the tray 20 may be inserted between the external flange 44 and the internal flange 46 of the housing portion 40 and fixed to the swivel joint 26 by means of the fixing screws 48. Construction of the remainder portion of the chair 100 is not described in detail herein, but it may be constructed using assembly methods common in the industry.

It will be obvious to those having skill in the art that many changes may be made to the details of the above-described embodiments without departing from the underlying principles of the invention. The scope of the present invention should, therefore, be determined only by the following claims.

The invention claimed is:

1. A joint for pivotably attaching a second article to a first article, the joint comprising:

a tubular inner structure configured to be arranged coaxially around the first article, wherein the tubular inner structure is non-rotatably connectable to the first article; and a mounting structure having an exterior surface configured to be coupled to the second article, the mounting structure including a first and second housing section each having an interior surface at least partially surrounding the tubular inner structure, wherein the mounting structure is pivotable about the tubular inner structure, wherein one of the tubular inner structure and the first housing section includes a track with a stop, and wherein the other of the tubular inner structure and the first housing section includes a projection engaging with the track, and wherein the stop of the track limits a range of rotation of the mounting structure about the tubular inner structure.

2. The joint of claim 1, the mounting structure further comprising a jacket non-rotatably connectable around the first and second housing sections, wherein the jacket is configured to be coupled to the second article.

3. The joint of claim 2, wherein the jacket is a single unitary component configured to be slidably fitted and secured around the first and second housing sections.

4. The joint of claim 2, wherein an exterior surface of each of the first and second housing sections includes a plurality of reinforcing ribs formed thereon, the ribs bearing against an interior surface of the jacket.

5. The joint of claim 1, wherein the projection is a separate component of and rigidly attached to the mounting structure.

6. The joint of claim 1, wherein the projection is formed as a single unitary piece of the mounting structure.

7. The joint of claim 1, wherein the projection is of a substantially strip-shaped configuration having a width substantially equal to a width of the track, the projection bearing against inside edges of the track.

8. The joint of claim 1, wherein the tubular inner structure is a separate component of and non-rotatably connectable to the first article.

9. The joint of claim 1, wherein the tubular inner structure is formed as a single unitary piece of the first article.

10. The joint of claim 1, wherein the mounting structure is coupled to the second article in a positively locking relationship.

11. The joint of claim 1, wherein both the first and second housing sections each include the track with the stop.

12. A swivel joint for pivotably coupling a tray to a support element of a seating implement, the swivel joint comprising:

a tubular inner structure configured to be arranged coaxially around the support element, wherein the tubular inner structure is non-rotatably connectable to the support element; and a mounting structure having an exterior surface configured to be coupled to the tray, the mounting structure including a first and second housing section each having an interior surface at least partially surrounding the tubular inner structure, wherein the mounting structure is pivotable about the tubular inner structure, wherein one of the tubular inner structure and the first housing section includes a track with a stop, and wherein the other of the tubular inner structure and the first housing section includes a projection engaging with the track, and wherein the stop of the track limits a range of rotation of the mounting structure about the tubular inner structure.

13. An article of furniture comprising:

a base frame structure;

a substantially planar panel;

a support structure for supporting the panel; and a joint for pivotably coupling the panel to the support structure, wherein the joint comprises:

a tubular inner structure arranged coaxially around the support structure, wherein the tubular inner structure is non-rotatably coupled to the support structure; and a mounting structure having an exterior surface coupled to the panel, the mounting structure including a first and second housing section each having an interior surface at least partially surrounding the tubular inner structure, wherein the mounting structure is pivotable about the tubular inner structure, wherein one of the tubular inner structure and the first housing section includes a track with a stop, and wherein the other of the tubular inner structure and the first housing section includes a projection engaging with the track, and wherein the stop of the track limits a range of rotation of the mounting structure about the tubular inner structure.

14. The article of claim 13, wherein the support structure is formed as a single unitary piece of the base frame structure.

15. The article of claim 13, wherein a portion of the support structure to which the joint is mounted extends substantially horizontally and substantially parallel to a main direction of use of the article of furniture.

16. The article of claim 13, wherein the article is a desk and the panel is a tray, and wherein the tray is pivotable between a position of use and a position of non-use.

17. The article of claim 13, the mounting structure further comprising a jacket around the first and second housing sections, wherein the jacket is coupled to the panel.

18. The article of claim 17, wherein the jacket is a single unitary component slidably fitted and secured around the first and second housing sections.

19. The article of claim 17, wherein an exterior surface of each of the first and second housing sections includes a plurality of reinforcing ribs formed thereon, the ribs bearing against an interior surface of the jacket.

20. The article of claim 13, wherein both the first and second housing sections each include the track with the stop.

21. A method of assembling a joint for a seating implement, the method comprising the steps of:

inserting a tubular inner structure having at least one opening onto a horizontal portion of a support element;

fixedly attaching the tubular inner structure to the support element;

fitting a mounting structure around the tubular inner structure, wherein the mounting structure includes a plurality of reinforcing ribs; and securing a housing having a plurality of securing pins over the mounting structure, where at least one of the plurality of securing pins engages at least one of the plurality of reinforcing ribs.

22. The method of claim 21, wherein the housing further includes an internal and external flange and the method further includes the steps of:

inserting a tray between the internal and external flanges; and securing the tray to the joint.

* * * * *